US006254351B1

(12) United States Patent
Culp

(10) Patent No.: US 6,254,351 B1
(45) Date of Patent: Jul. 3, 2001

(54) SNAP-ACTING FLOAT ASSEMBLY WITH HYSTERESIS

(75) Inventor: Robert J. Culp, Parkland, PA (US)

(73) Assignee: Milton Roy Company, Ivyland, PA (US)

( * ) Notice: Subject to any disclaimer, the term of this patent is extended or adjusted under 35 U.S.C. 154(b) by 0 days.

(21) Appl. No.: 09/490,490

(22) Filed: Jan. 25, 2000

(51) Int. Cl.[7] ..... F04B 49/04; H01H 35/18

(52) U.S. Cl. ..... 417/40; 200/84 B; 200/84 R

(58) Field of Search ..... 417/40; 200/84 R, 200/84 B; 73/313; 74/97.1

(56) References Cited

U.S. PATENT DOCUMENTS

| | | | | |
|---|---|---|---|---|
| 495,377 | | 4/1893 | Searle | 137/196 |
| 1,882,196 | | 10/1932 | Siems | 73/313 |
| 2,054,205 | | 9/1936 | Palmer | 200/84 B |
| 2,433,968 | * | 1/1948 | Wiseley | 200/84 R |
| 2,592,908 | | 4/1952 | Katz | 137/104 |
| 2,616,003 | | 10/1952 | MacDonald | 200/84 |
| 2,616,004 | | 10/1952 | Richards | 200/84 |
| 2,694,171 | | 11/1954 | Campbell | 318/482 |
| 2,761,467 | | 9/1956 | Arne | 137/452 |
| 2,920,644 | | 1/1960 | Schulze et al. | 137/391 |
| 3,116,383 | | 12/1963 | Hoffner | 200/84 |
| 3,153,422 | | 10/1964 | Marsee et al. | 137/434 |
| 3,594,722 | | 7/1971 | Shultz | 340/59 |
| 3,619,084 | * | 11/1971 | Gordon | 417/40 |
| 3,989,043 | | 11/1976 | Dimeff | 128/214 |
| 4,080,985 | | 3/1978 | Eagle | 137/429 |
| 4,081,638 | | 3/1978 | Thorn et al. | 200/84 |
| 4,084,073 | * | 4/1978 | Keener | 200/84 R |
| 4,301,824 | | 11/1981 | Payne | 137/110 |
| 5,309,939 | | 5/1994 | Stickel et al. | 137/387 |
| 5,493,086 | * | 2/1996 | Murphy, Jr. et al. | 200/84 R |
| 5,814,780 | | 9/1998 | Batchelder et al. | 200/84 |

* cited by examiner

*Primary Examiner*—Timothy S. Thorpe
*Assistant Examiner*—Michael K. Gray

(57) ABSTRACT

A float assembly for use in actuating a switch based on the level of a fluid includes a pivot member having a pivot axis and a switching surface. First and second floats are coupled to the pivot member so that at a first fluid level the first and second floats lie on different sides of a vertical line extending through the pivot axis and the switching surface causes the switch to assume a first switching state. At a second fluid level, the first and second floats lie on the same side of the vertical line extending through the pivot axis and the switching surface causes the switch to assume a second switching state.

31 Claims, 3 Drawing Sheets

SNAP-ACTING FLOAT ASSEMBLY WITH HYSTERESIS

BACKGROUND OF THE INVENTION

1. Field of the Invention

The present invention relates generally to float assemblies for sensing fluid levels and, more particularly, to a float assembly for actuating a switch.

2. Background Art

Conventional float assemblies for actuating a switch based on a fluid level typically include a pushrod that extends upwardly from a float and which moves vertically with the float in response to changes in the fluid level. The pushrod may actuate the switch directly or, alternatively, may actuate the switch via an intermediate lever.

In applications where the float assembly controls the operation of a pump, it is desirable to provide switching hysteresis or a control deadband that allows the pump motor to cycle between on and off operational states at an acceptable frequency and duty cycle. As is commonly known, without switching hysteresis, electrical noise or high flow rates into the pumped container may cause the pump motor to cycle rapidly between on and off states when the fluid level is near the switching point. Such rapid cycling of the pump motor can substantially increase power consumption and shorten the life expectancy of the pump motor. It is further desirable to provide a positive (i.e., substantially bounceless) switching action because mechanical bouncing of the switch contacts may cause the pump motor to be turned on and off rapidly despite any switching hysteresis or control deadband and may cause premature wear and failure of the switch contacts.

Some conventional float assemblies provide a control deadband by coupling the float pushrod to the switch via a lost motion connection, which allows the vertical displacement of the float to change over a predetermined range of fluid levels without causing any actuation of the switch. Additionally, many of these conventional float assemblies also incorporate an electrical switch having a snap-acting or detent mechanism to provide a positive switching action that eliminates or minimizes contact bounce.

In one known configuration illustrated in FIG. 1, a conventional float 10 follows the level of a fluid within a tank 12. A pushrod 14 extends coaxially from the float 10 and is coupled to the float 10 so that the pushrod 14 follows the vertical displacement of the float 10. The pushrod 14 passes freely through an opening (not shown) in a lever arm 16 which is coupled to a detent switch 18. The pushrod 14 includes an upper pushnut 20 and a lower pushnut 22 that define a control deadband therebetween. This control deadband allows the pushrod 14 to move vertically through the lever arm 16 a predetermined distance without actuating the lever arm 16 or the detent switch 18.

At a low fluid level 24, the pushrod 14 is retracted into the tank 12 so that the upper pushnut 20 pulls the lever arm 16 downward to cause the detent switch 18 to be in one of two switching states. Similarly, at a high fluid level 26, the pushrod extends out of the tank 12 so that the lower pushnut 22 pushes the lever arm 16 upward to cause the detent switch 18 to be in the other one of the two switching states.

While the float assembly shown in FIG. 1 establishes a control deadband so that a pump motor controlled by the detent switch 18 is turned on at one fluid level and turned off at another fluid level, the structure of FIG. 1 is relatively expensive to manufacture because it requires the use of an expensive detent switch. Further, placement of the pushnuts 20 and 22 on the pushrod 14 is labor intensive and tends to be imprecise, leading to a wide variation in the minimum and maximum controlled fluid levels.

SUMMARY OF THE INVENTION

In accordance with one aspect of the present invention, a float assembly includes a carrier rotatable about a pivot axis. The carrier includes an actuation surface which is disposed at an actuating position when the carrier is disposed at a first rotational position and which is moved away from the actuating position when the carrier is rotated away from the first rotational position toward a second rotatable position.

The float assembly may further include a pair of spaced floats coupled to the carrier. The floats may be disposed on a certain side of a vertical line extending through the pivot axis when the carrier is disposed at the first rotational position and the floats may be disposed on opposite sides of the vertical line extending through the pivot axis when the carrier is disposed at the second rotational position.

The float assembly may be used in combination with a switch having an actuation arm which is moved to a switch actuation position by the actuation surface as the carrier is rotated to the first rotational position and the actuation arm may be biased by a spring to a switch deactuation position as the carrier is rotated toward the second rotational position.

In accordance with another aspect of the present invention, a float assembly for actuating a switch based on a level of a fluid includes a pivot member having a pivot axis and a switching surface and first and second floats coupled to the pivot member. At a first fluid level, the first and second floats lie on different sides of a vertical line extending through the pivot axis and the switching surface causes the switch to assume a first switching state and, at a second fluid level, the first and second floats lie on the same side of the vertical line extending through the pivot axis and the switching surface causes the switch to assume a second switching state.

In accordance with yet another aspect of the present invention, a float assembly includes a pivot member having a pivot axis and a float coupled to the pivot member. The float provides a first torque to the pivot member in a first direction when the float lies substantially to one side of a vertical line extending through the pivot axis and a second torque in a second direction to the pivot member when the float lies substantially on another side of the vertical line extending through the pivot axis. The float assembly may further include a means for applying a third torque in the second direction to the pivot member to cause the float to move from substantially the one side to substantially the other side of the vertical line through the pivot axis.

The invention itself, together with further objects and attendant advantages, will best be understood by reference to the following detailed description, taken in conjunction with the accompanying drawings.

DETAILED DESCRIPTION OF THE PREFERRED EMBODIMENTS

The float assembly described herein eliminates the need to use a snap-acting or detent switch and pushnuts, which are commonly used with conventional float assemblies, and instead uses one or more floats mounted on a carrier or pivot member to provide a snap-acting float assembly with hysteresis. Thus, the float assembly described herein may be used to actuate a relatively inexpensive limit switch to control the operation of a pump so that the pump motor is not subjected to rapid cycling between on and off conditions.

Figure 1:
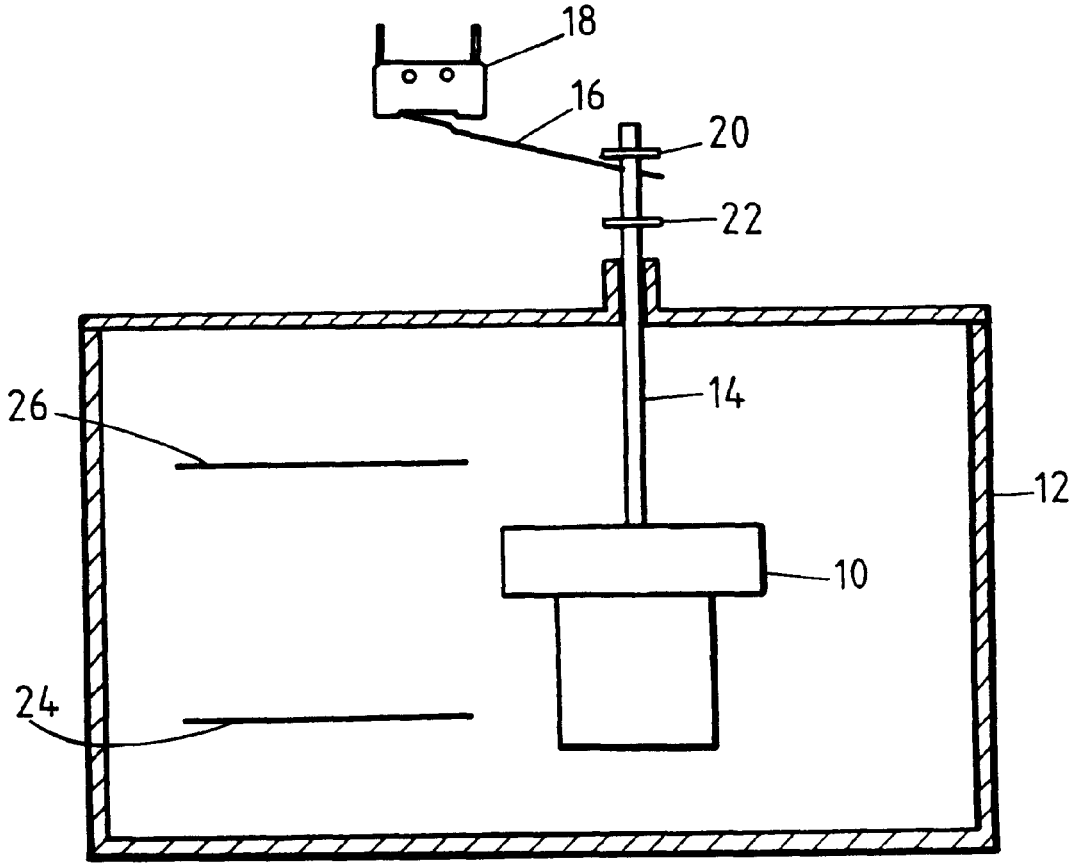
FIG. 1 PRIOR ART
FIG. 1 is a diagrammatic, partial sectional view illustrating a prior art configuration for a float assembly that actuates a switch based on a fluid level.
Figure 3:
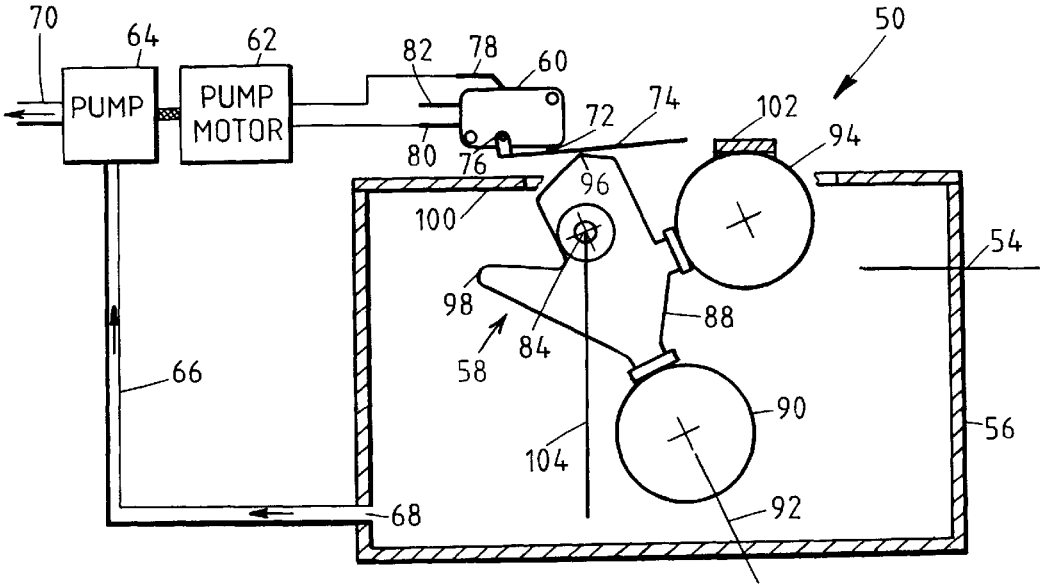
FIG. 3 is a view similar to FIG. 2 with the carrier or pivot member in a second position.
Figure 2:
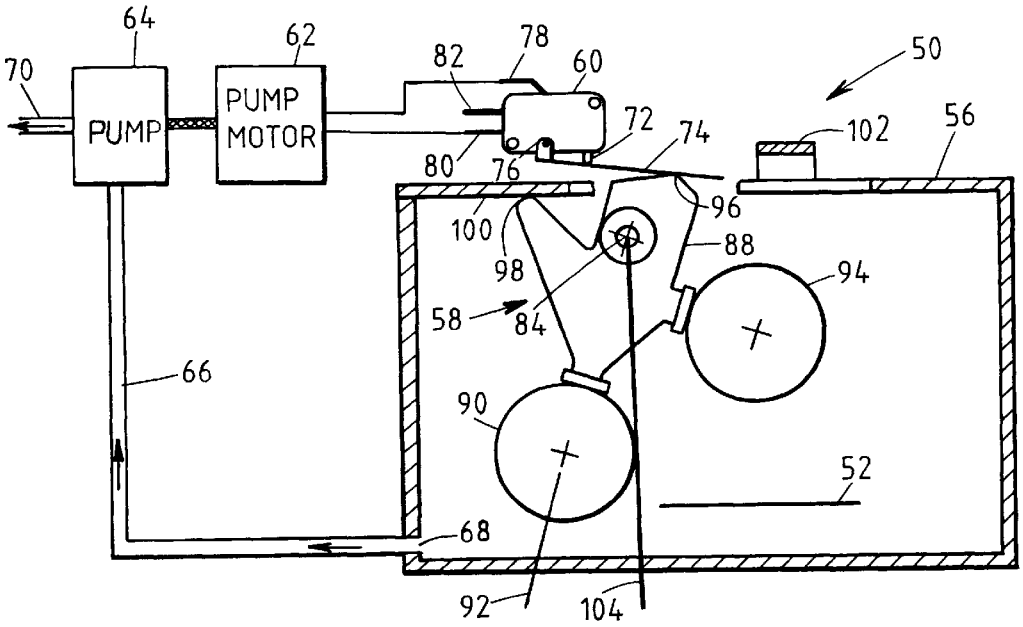
FIG. 2 is an elevational view, partially in section, of a fluid reservoir system incorporating the float assembly of the present invention with a carrier or pivot member in a first position together with a block diagram of a pump and pump motor.

FIGS. 2 and 3 are views of a fluid reservoir system 50 that controls the level of a fluid between a minimum fluid level 52 and a maximum fluid level 54. The fluid reservoir system 50 includes a container or tank 56, a float assembly 58, a limit switch 60, a pump motor 62 and a pump 64. The fluid reservoir system 50 may be, for example, a system that collects condensate (i.e., condensed water vapor) in one location and conveys the collected condensate away from the fluid reservoir system 50.

The pump 64 is driven by the pump motor 62 and is coupled via a fluid conduit 66 to an opening 68 in the tank 56. The pump motor 62 drives the pump 64 to remove fluid from the tank 56 via the fluid conduit 66 and conveys the removed fluid to an outlet conduit 70, which carries the removed fluid away from the fluid reservoir system 50. Preferably, the opening 68 is located below the minimum fluid level 52 to enable the pump 64 to draw fluid from the tank 56 when the fluid level is at or near the minimum level 52 without drawing air into the fluid conduit 66 and the pump 64. While the pump 64 is configured to remove fluid from the tank 56, alternative configurations may be used. For example, the pump 64 and the opening 68 may be configured so that the pump 64 adds fluid to the tank 56 via the fluid conduit 66. Also, the pump 64 and/or motor 62 may be disposed within the tank 56.

The pump motor 62 may be any electrical motor suitable for the particular application of the fluid reservoir system 50. Additionally, the pump motor 62 may be integral with the pump 64 or may, alternatively, be separate from the pump 64, in which case the pump motor 62 may be coupled to the pump 64 via a shaft, gear train, magnetic coupling, and/or any other suitable coupling mechanism.

The limit switch 60 includes a switch button 72, a spring biased switch actuation arm 74 that is mounted to the limit switch 60 at a pivot point 76 and which may be moved against the spring bias to depress the switch button 72, a common terminal 78, a normally-open terminal 80 and a normally-closed terminal 82. The common terminal 78 and the normally-open terminal 80 are serially interposed in the path of power supplied to the pump motor 62 so that when the switch button 72 is not depressed, the limit switch 60 is not activated and interrupts the flow of power to the pump motor 62 so that the pump 64 is inactive.

As is commonly known, limit switches, such as the limit switch 60, are relatively inexpensive in comparison to snap-acting and detent switches, which are typically used with conventional float-based fluid level control systems. Although the float assembly described herein may be advantageously used within a fluid level control system (such as the fluid level control system 50 shown in FIGS. 2 and 3) to allow the use of an inexpensive limit switch for the control of a pump motor, conventional snap-acting and detent switches, as well as other types of switches, may nevertheless be used with the float assembly described herein.

The float assembly 58 rotates clockwise and counter-clockwise about a pivot axis 84 in response to changes in the fluid level within the tank 56. The float assembly 58 includes a carrier or pivot member 88, a lower float 90 disposed on centerline 92, an upper float 94, a switching surface 96, and a pivot member stop surface 98. The pivot member stop surface 98 contacts a wall 100 of the tank 56 to limit the clockwise rotation of the float assembly 58 and the upper float 94 contacts a tank stop surface 102, which may be integral to the tank 56, to limit counter-clockwise rotation of the float assembly 58.

The switching surface 96 acts as a cam surface that converts the angular or rotational position of the float assembly 58 into a vertical displacement of the switch actuation arm 74 and the switch button 72. Preferably, the switching surface 96 is profiled so that as the lower float centerline 92 moves to the right of a vertical line 104 extending through the pivot axis 84, the switching surface 96 vertically displaces the switch actuation arm 74 to depress the switch button 72, thereby activating the limit switch 60. When activated, the limit switch 60 completes an electrical path between the common and normally-open terminals 78 and 80 which turns the pump motor 62 on so that fluid is removed from the tank 56.

Generally speaking, the pivoting action of the float assembly 58 is determined by the pivot member 88, the weight and buoyancy (which are a function of density and geometry) of the floats 90 and 94, and the location of the floats 90 and 94 with respect to the pivot axis 84 and the vertical line 104. As will be discussed in more detail below, the center of gravity of the pivot assembly 58 lies on or, preferably, to the right of the vertical line 104 as seen in FIGS. 2 and 3. Thus, when the fluid level is below the minimum level 52, the float assembly 58 rotates to the fully clockwise position to drive the pivot member stop surface 98 against the wall 100. While the weight and location of the floats 90 and 94 can substantially determine the center of gravity of the pivot assembly 58, those skilled in the art will recognize that the center of gravity of the pivot assembly 58 is also determined, at least in part, by many other factors including, but not limited to, the materials and geometry of the pivot member 88.

When the fluid level rises to contact one or more of the floats 90 and 94, the buoyancies of the floats 90 and 94 become dominant in controlling the rotational position of the pivot assembly 58. In general, the respective buoyant forces and torques provided by the floats 90 and 94 increase in direct proportion to the volume of fluid which is displaced by each of the floats 90 and 94.

The magnitudes and directions of the buoyant torques exerted by the floats 90 and 94 change as the rotational position of the pivot assembly 58 varies. This is due to the fact that the direction and magnitude of the torque developed by each float are dependent upon the angle between the vertical line 104 and a line extending through the pivot axis 84 and the center of the float. Preferably (although not necessarily) the magnitude of the counter-clockwise buoyant torque provided by the upper float 94 increases as the pivot member 88 rotates counter-clockwise from the fully clockwise position to the fully counter-clockwise position. On the other hand, the magnitude of the torque provided by the lower float 90 decreases to zero as the pivot member 84 rotates to bring the lower float centerline 92 into coincidence with the vertical line 104 and increases from zero as the lower float centerline 92 moves to the right of the vertical line 104.

One particularly interesting aspect of the float assembly 58 is that the direction of the buoyant torque provided by the lower float 90 changes abruptly as the lower float centerline 92 crosses the vertical line 104. Specifically, when the lower float centerline 92 lies to the left of the vertical line 104, the lower float 90 provides a clockwise buoyant torque and when the lower float centerline 92 lies to the right of the vertical line 104, the lower float 90 provides a counter-clockwise buoyant torque. As described in more detail below, this abrupt reversal in the direction of the buoyant torque provided by the lower float 90 results in a snap-action pivoting movement for the pivot assembly 58.

The manner in which the above-described torques interact to provide a snap-acting float assembly with hysteresis can be best understood in connection with the following exemplary description of the operation of the fluid reservoir system 50 of FIGS. 2 and 3. Initially, the tank 56 is empty, and because the center of gravity of the pivot assembly 58 lies to the right of the vertical line 104, the pivot member 58 to rotates fully clockwise to drive the pivot stop surface 98 against the wall 100. With the float assembly 58 in the fully clockwise position (i.e., with the pivot member stop surface 98 in contact with the wall 100), the switching surface 96 is spaced from the switch actuation arm 74 allowing the arm 74 to be biased downwardly so that the switch button 72 is not depressed. As a result, the pump motor 62 and pump 64 are off, and fluid is not removed from the tank 56.

As the fluid level within the tank 56 rises, the fluid first contacts the lower float 90, which causes the lower float 90 to exert a clockwise buoyant torque on the float assembly 58, thereby holding the pivot member stop surface 98 firmly in place against the wall 100 (as shown in FIG. 2). Further, as the fluid level continues to rise, an increasing proportion of the lower float 90 becomes submerged which increases the clockwise buoyant torque provided by the lower float 90. When the fluid level rises sufficiently high to completely submerge the lower float 90, the lower float 90 exerts a maximum clockwise buoyant torque on the pivot assembly 58.

When the fluid level rises to contact the upper float 94, the upper float 94 begins to provide a counter-clockwise buoyant torque to the pivot assembly 58. Eventually, when a sufficient portion of the upper float 94 becomes submerged, the counter-clockwise buoyant torque provided by the upper float 94 exceeds the maximum clockwise buoyant torque provided by the lower float 90. This effect may be achieved in any suitable manner, such as by designing the upper float 94 to have a greater buoyancy than the lower float 90 and/or locating the upper float 94 at a suitable distance from the pivot axis 84 relative to the distance of the lower float 90 from the pivot axis 84, etc. In any event, further increases in the fluid level cause the pivot assembly 58 to rotate counter-clockwise. When the fluid level rises sufficiently (i.e., to the maximum fluid level 54) to cause the lower float centerline 92 to cross the vertical line 104, the clockwise buoyant torque provided by the lower float 90 abruptly changes direction to become a counter-clockwise buoyant torque which, without any further increase in the fluid level, causes the float assembly 58 to rotate fully counter-clockwise so that the upper float 94 is driven against the tank stop surface 102 (as shown in FIG. 3). Additionally, as the lower float centerline 92 crosses to the right of the vertical line 104, the switching surface 96 displaces the switch actuation arm 74 upward to depress the switch button 72 and activate the limit switch 60. When activated, the limit switch 60 provides an electrical path between the common and normally-open terminals 78 and 80 to turn the pump motor 62 on, which drives the pump 64 to remove fluid from the tank 56.

As the pump 64 decreases the fluid level within the tank 56 to below the level of the upper float 94, the float assembly 58 remains rotated fully counter-clockwise with the upper float 94 driven against the tank stop surface 102. The float assembly remains in the fully counter-clockwise position because the lower float centerline 92 remains to the right of the vertical line 104 and the lower float 90 provides a counter-clockwise buoyant torque that is greater than the clockwise torque provided by the weight of the pivot assembly 58. As a result, the limit switch 60 continues to provide power to the pump motor 62 and the pump 64 continues to remove fluid from the tank 56.

When the fluid level decreases to about the minimum level 52 (as shown in FIG. 2), the counter-clockwise buoyant torque provided by the lower float 90 becomes substantially zero and the clockwise torque provided by the weight of the pivot assembly 58 causes the float assembly 58 to rotate fully clockwise to drive the pivot member stop surface 98 against the wall 100, thereby allowing the spring biased switch actuation arm 74 to move downward to deactivate the limit switch 60, which turns off the pump motor 62 so that the pump 64 stops removing fluid from the tank 56.

As can be understood from the above discussion of the operation of the float assembly 58, the switching surface 96 of the float assembly 58 causes the limit switch 60 to switch between two switching states so that one of the two states turns the pump motor 62 on at the maximum fluid level 54 and the other of the two switching states turns the pump motor 62 off at the minimum fluid level 52. Thus, the operation of the float assembly 58 provides switching hysteresis that eliminates rapid cycling of the pump motor 62. Additionally, the float assembly described herein provides a positive detent or snap-action switching action due to the reversal of the direction of the buoyant torque provided by lower float 90 that occurs as the lower float centerline 92 crosses the vertical line 104.

Those skilled in the art will recognize that the floats 90 and 94 may be made from any suitable material providing buoyancy such as, for example, styrofoam. Additionally, the floats 90 and 94 may be approximately spherical in shape or may, alternatively, be of any other shape needed to accomplish the above-described pivoting action in response to a fluid level. In fact, the floats 90 and 94 may be integrated so that the function of the separate floats 90 and 94 is accomplished using a substantially one-piece float. Further, the shape, material, volume, location with respect to the pivot axis 84 and one another, etc. of the floats 90 and 94 may be different, if needed, to provide any desired pivoting action, minimum fluid level, maximum fluid level, etc. Still further, those skilled in the art will recognize that the upper float 94 may be eliminated altogether and instead a lever arm or any other mechanical and/or electromechanical device may be substituted and manually or automatically controlled based on fluid level or some other parameter to apply a torque to the pivot assembly 58 to cause the lower float centerline 92 to cross the vertical line 104.

Figure 4:
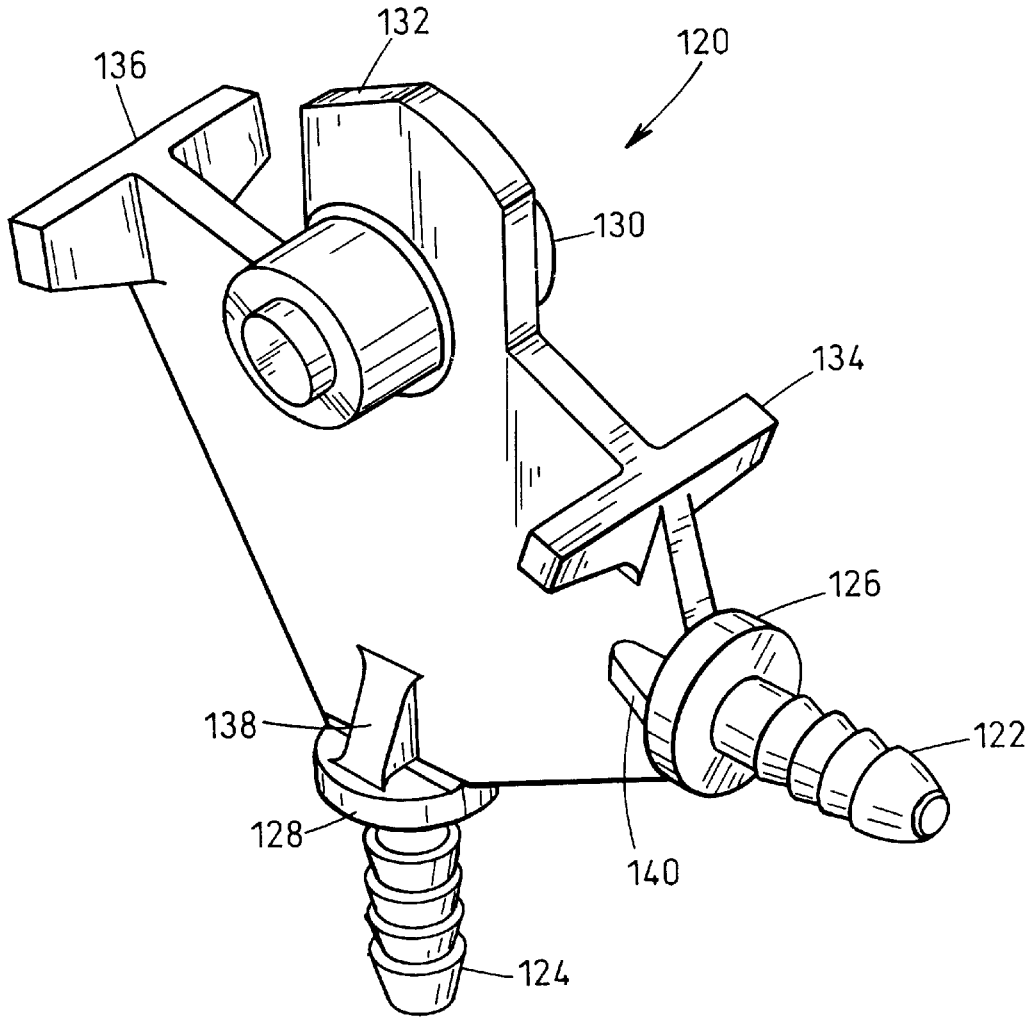
FIG. 4 is an isometric view of the carrier or pivot member shown in FIGS. 2 and 3.

FIG. 4 is an exemplary isometric view of a pivot member 120 that may be used with the float assembly 58 shown in FIGS. 2 and 3. The pivot member 120 includes barbed fittings 122 and 124 for securely engaging with complementary openings (not shown) in the floats 90 and 94, shoulder portions 126 and 128, a pivot bearing 130, a cam surface 132, and stops 134 and 136. Fillets or webs 138 and 140 (and other fillets which are not shown) may be included to strengthen the shoulder portions 126 and 128 to prevent breakage of the barbed fittings 122 and 124 when pressing the floats 90 and 94 onto the barbed fittings 122 and 124. Preferably, the pivot member 120 is a one-piece structure molded from a thermoplastic material. Alternatively, the pivot member 120 may be a die-cast part or may be fabricated using one or more component pieces from plastics, metals, and/or any other suitable materials.

Those of ordinary skill in the art will readily appreciate that a range of changes and modifications can be made to the preferred embodiments described above. The foregoing detailed description should be regarded as illustrative rather than limiting and the following claims, including all equivalents, are intended to define the scope of the invention.

What is claimed is:

1. A float assembly, comprising:

a carrier rotatable about a pivot axis and including an actuation surface which is disposed at an actuating position when the carrier is disposed at a first rotational position and which is moved away from the actuating position when the carrier is rotated away from the first rotational position toward a second rotatable position; and a pair of spaced floats coupled to the carrier wherein the floats are disposed on a certain side of a vertical line extending through the pivot axis when the carrier is disposed at the first rotational position and wherein the floats are disposed on opposite sides of the vertical line extending through the pivot axis when the carrier is disposed at the second rotational position.

2. The float assembly of claim 1, in combination with a switch.

3. The float assembly of claim 2, wherein the switch includes an actuation arm which is moved to a switch actuation position by the actuation surface as the carrier is rotated toward the first rotational position.

4. The float assembly of claim 2, wherein the actuation arm is biased by a spring to a switch deactuation position as the carrier is rotated toward the second rotational position.

5. The float assembly of claim 1, in combination with a container within which the float assembly is mounted.

6. The float assembly of claim 5, wherein the container includes a container stop surface which is contacted by one of the floats when the carrier is disposed in the first rotational position.

7. The float assembly of claim 5, wherein the carrier includes a carrier stop surface that contacts a wall of the container when the carrier is disposed in the second rotational position.

8. The float assembly of claim 5, wherein the container is adapted to hold a liquid having a varying liquid level and wherein one of the floats is disposed below the other float and the one float exerts a torque in a first direction on the carrier when the liquid level is above a first level but below a second level and exerts a torque in a second direction different than the first direction on the carrier when the liquid level is above the second level.

9. The float assembly of claim 8, wherein the other float exerts a torque in the second direction when the liquid level is above the second level.

10. The float assembly of claim 1, wherein a center of gravity of the carrier and the floats is disposed on the certain side of the vertical line extending through the pivot axis.

11. A float assembly for actuating a switch based on a level of a fluid, the float assembly comprising.

a pivot member having a pivot axis and a switching surface;

a first float coupled to the pivot member; and a second float coupled to the pivot member, wherein at a first fluid level the first and second floats lie on different sides of a vertical line extending through the pivot axis and the switching surface causes the switch to assume a first switching state, and wherein at a second fluid level the first and second floats lie on the same side of the vertical line extending through the pivot axis and the switching surface causes the switch to assume a second switching state.

12. The float assembly of claim 11, wherein the first float is coupled to the pivot member at a first location with respect to the pivot axis and the second float is coupled to the pivot member at a second location with respect to the pivot axis.

13. The float assembly of claim 11, wherein the first float provides a first buoyant torque about the pivot axis and the second float provides a second buoyant torque about the pivot axis greater than the first buoyant torque.

14. The float assembly of claim 13, wherein the first and second buoyant torques are in different directions.

15. The float assembly of claim 11, wherein the switching surface comprises a cam surface that is profiled to actuate the switch between on and off states when a centerline of one of the first and second floats crosses the vertical line extending through the pivot axis.

16. The float assembly of claim 11, further including a pump coupled to the switch and wherein the first switching state turns the pump off to allow the fluid level to increase and the second switching state turns the pump on to cause the fluid level to decrease.

17. The float assembly of claim 11, wherein the first and second floats have substantially the same shape.

18. The float assembly of claim 11, wherein the first and second floats have substantially the same density.

19. A float assembly, comprising:

a pivot member having a pivot axis;

a float coupled to the pivot member to provide a first torque to the pivot member in a first direction when the float lies substantially to one side of a vertical line extending through the pivot axis and a second torque in a second direction to the pivot member when the float lies substantially on another side of the vertical line extending through the pivot axis; and means for applying a third torque in the second direction to the pivot member to cause the float to move from substantially one side to substantially the other side of the vertical line through the pivot axis.

20. The float assembly of claim 19, wherein the means for applying the third torque comprises a second float.

21. The float assembly of claim 20, wherein at a first level of a fluid the first and second floats lie on different sides of the vertical line extending through the pivot axis and wherein at a second level of the first and second floats to lie on the same side of the vertical line extending through the pivot axis.

22. The float assembly of claim 19, wherein the pivot member further includes a switching surface that causes a switch to switch between first and second switching states associated with respective first and second levels of a fluid.

23. A float assembly for use in controlling a fluid within a fluid reservoir system having a tank that holds the fluid, a pump motor, and a limit switch serially interposed in an electrical path supplying power to the pump motor, the float assembly comprising:

pivot member having a pivot axis and a switching surface;

a first float coupled to the pivot member; and a second float coupled to the pivot member, wherein at a first level of the fluid in the tank the first and second floats lie on different sides of a vertical line extending through the pivot axis and the switching surface causes the limit switch to assume a first switching state that changes the flow of power to the pump motor, and wherein at a second level of the fluid the first and second floats lie on the same side of the vertical line extending through the pivot axis and the switching surface causes the limit switch to assume a second switching state that changes the flow of power to the pump motor.

24. The float assembly of claim 23, wherein the first float provides a first buoyant torque about the pivot axis which is less than a second buoyant torque provided by the second float.

25. The float assembly of claim 24, wherein the first and second buoyant torques oppose one another.

26. The float assembly of claim 23, wherein the second fluid level is greater than the first fluid level.

27. The float assembly of claim 23, wherein the first switching state turns the pump motor off and the second switching state turns the pump motor on.

28. The float assembly of claim 23, wherein the first switching state allows the fluid level in the tank to increase and the second switching state allows the fluid level in the tank to decrease.

29. The float assembly of claim 23, wherein the first and second floats have substantially the same shape.

30. The float assembly of claim 23, wherein the first and second floats have substantially the same volume.

31. The float assembly of claim 23, wherein the first and second floats have substantially the same density.

* * * * *